US010458183B2

(12) United States Patent
Tiber et al.

(10) Patent No.: US 10,458,183 B2
(45) **Date of Patent: *Oct. 29, 2019**

(54) STEPLADDER HAVING A LADDER TOP WITH CONDUIT HOLDER SLOT AND METHOD

(71) Applicants: Robert C. Tiber, Clark, PA (US); Joseph C. Dangrow, Mercer, PA (US); Tracee A. Leonardson, Ashtabula, OH (US)

(72) Inventors: Robert C. Tiber, Clark, PA (US); Joseph C. Dangrow, Mercer, PA (US); Tracee A. Leonardson, Ashtabula, OH (US)

(73) Assignee: Werner Co., Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/256,036

(22) Filed: Sep. 2, 2016

(65) Prior Publication Data

US 2016/0369562 A1 Dec. 22, 2016

Related U.S. Application Data

(62) Division of application No. 13/890,924, filed on May 9, 2013, now Pat. No. 9,435,155.

(51) Int. Cl.

| | |
|---|---|
| ***E06C 7/14*** | (2006.01) |
| ***E06C 7/46*** | (2006.01) |
| ***B26D 7/01*** | (2006.01) |

(52) U.S. Cl.

CPC ..... *E06C 7/14* (2013.01); *B26D 7/01* (2013.01); *E06C 7/46* (2013.01); *Y10T 83/04* (2015.04)

(58) Field of Classification Search

CPC ..... E06C 7/14

See application file for complete search history.

(56) References Cited

U.S. PATENT DOCUMENTS

| | | | | | |
|---|---|---|---|---|---|
| 3,156,443 | A * | 11/1964 | Lupinacci | E06C 7/14 | 248/211 |
| 3,887,034 | A * | 6/1975 | Sawatzky | E06C 7/14 | 182/129 |
| 4,318,454 | A * | 3/1982 | Johnson | E06C 7/14 | 182/129 |
| 4,995,578 | A * | 2/1991 | Monheim | E06C 7/14 | 182/129 |
| 6,880,794 | B1 * | 4/2005 | Kahn | A45F 5/02 | 24/115 R |
| 7,159,694 | B2 * | 1/2007 | Gibson | E06C 1/393 | 182/129 |

(Continued)

*Primary Examiner* — Marcus Menezes

(74) *Attorney, Agent, or Firm* — Ansel M. Schwartz

(57) ABSTRACT

The present invention pertains to a stepladder. The stepladder includes a ladder top having a plane having a front side and a rear side and a left side and a right side and a front side flange and a rear side flange and a left side flange and a right side flange. The stepladder includes a conduit holder slot for holding tubing, pipe and conduit. The conduit holder slot extends along the entire length of the top and in the right side and the left side. The conduit holder slot has a cross-section in the ladder top which is non-symmetrical. The stepladder includes a front section. The stepladder includes a rear section. A method for cutting a tube.

11 Claims, 7 Drawing Sheets

(56) References Cited

U.S. PATENT DOCUMENTS

| | | | | |
|---|---|---|---|---|
| 8,511,661 | B2 * | 8/2013 | Huang | B23Q 3/04<br>269/309 |
| 9,435,155 | B2 * | 9/2016 | Tiber | B26D 7/01 |
| 2003/0213646 | A1 * | 11/2003 | Gallion | E06C 7/14<br>182/129 |
| 2005/0284701 | A1 * | 12/2005 | Gibson | A47C 12/00<br>182/165 |
| 2007/0193828 | A1 * | 8/2007 | Astor | E06C 1/39<br>182/129 |
| 2007/0193829 | A1 * | 8/2007 | Astor | E06C 7/14<br>182/129 |
| 2009/0229918 | A1 * | 9/2009 | Moss | E06C 1/18<br>182/129 |
| 2009/0283361 | A1 * | 11/2009 | Gibson | E06C 7/14<br>182/129 |
| 2011/0100752 | A1 * | 5/2011 | Donlon | E06C 7/42<br>182/107 |

* cited by examiner

STEPLADDER HAVING A LADDER TOP WITH CONDUIT HOLDER SLOT AND METHOD

This is a divisional of U.S. patent application Ser. No. 13/890,924 filed on May 9, 2013, now U.S. Pat. No. 9,435,155, incorporated by reference herein.

FIELD OF THE INVENTION

The present invention is related to a stepladder with a ladder top having a conduit holder slot. (As used herein, references to the "present invention" or "invention" relate to exemplary embodiments and not necessarily to every embodiment encompassed by the appended claims.) More specifically, the present invention is related to a stepladder with a ladder top having a conduit holder slot, where the conduit holder slot has a cross-section in the ladder top which is non-symmetrical.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Ladder tops on step ladders are designed to assist users with the tasks they are to perform. The ladder top is designed to provide easy access to the tools and products that the user is using while on the ladder. The features of the ladder top are not merely a design choice. Thought must go into the layout and positioning of the different features of the ladder top so they do not necessarily conflict with each other or create a precarious position for a given tool or product while it is being used on top of the ladder. Furthermore, in regard to grooves or slots that are in the ladder top to hold a pipe, conduit or tube, it is common that when the conduit is placed in such a groove, the user needs to cut or saw the conduit to size. When the user applies a cutting or sawing action, a simple groove or slot does not necessarily facilitate the cutting or sawing of the conduit in the groove because the force from the cutting or sawing could push or move the conduit out of the groove.

BRIEF SUMMARY OF THE INVENTION

The present invention pertains to a stepladder. The stepladder comprises a ladder top having a plane having a front side and a rear side and a left side and a right side and a front side flange and a rear side flange and a left side flange and a right side flange. The stepladder comprises a conduit holder slot for holding tubing, pipe and conduit. The conduit holder slot extends along the entire length of the top and in the right side and the left side. The conduit holder slot has a cross-section in the ladder top which is non-symmetrical. The stepladder has a front section having a first front rail and a second front rail in parallel and spaced relation with the first front rail and a step attached to the first and second front rail. The first front rail and the second front rail extend from the top and are permanently attached to a respective side flange. The stepladder comprises a rear section having a first rear rail and a second rear rail in parallel and spaced relation with the first rear rail. The first rear rail and the second rear rail extend from the top and are permanently attached to a respective side flange. The ladder top and the front and rear sections form the stepladder.

The present invention pertains to a method for cutting a tube. The method comprises the steps of placing the tube onto a conduit holder slot on a ladder top of a stepladder. The conduit holder slot for holding tubing, pipe or conduit. The conduit holder slot extending along the entire length of the top and in the top's right side and left side. The conduit holder slot having a cross section in the ladder top which is non-symmetrical. There is the step of cutting the tube while it is disposed in the conduit holder slot.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
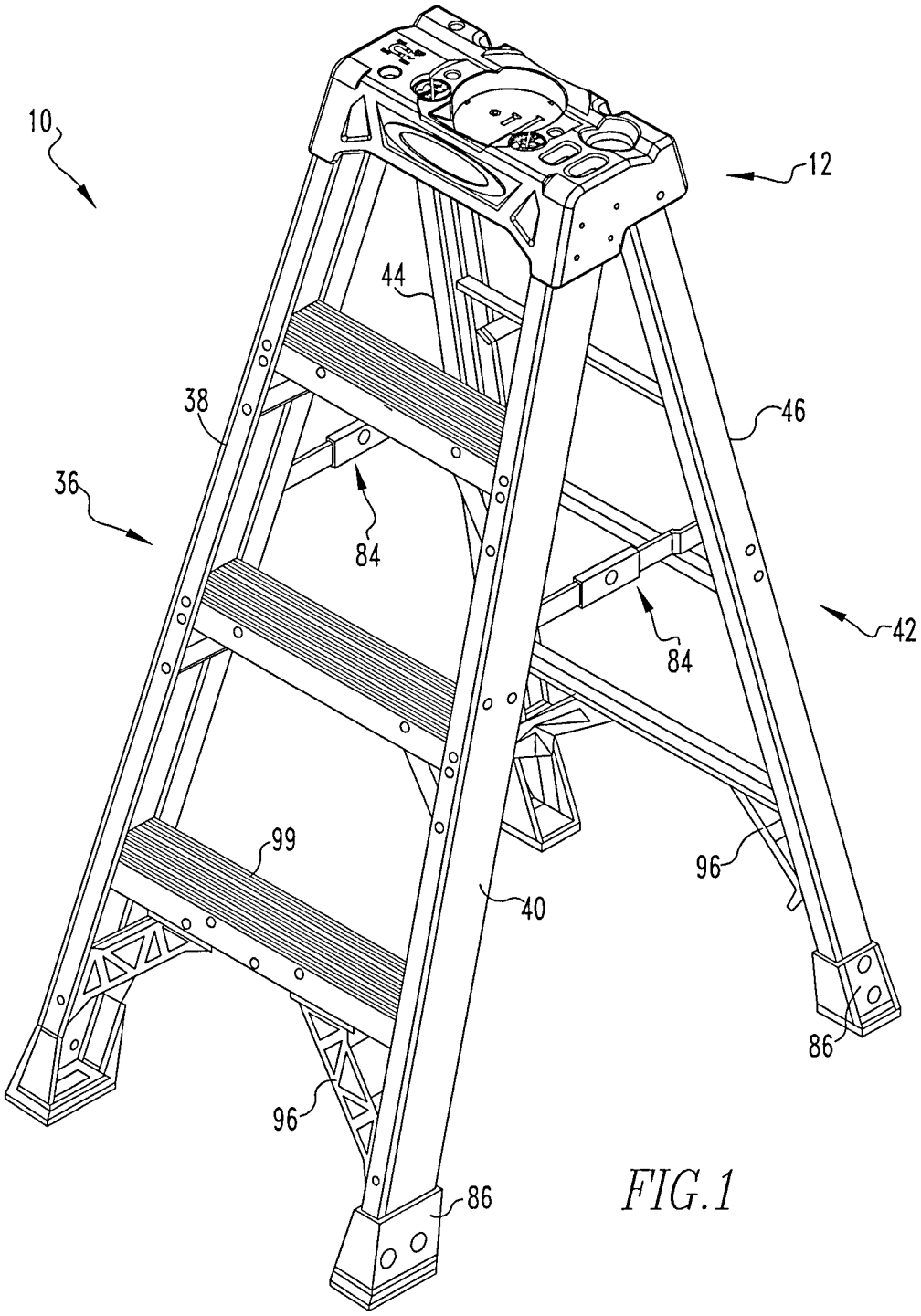
FIG. 1 is a perspective view of a stepladder of the present invention.
Figure 2:
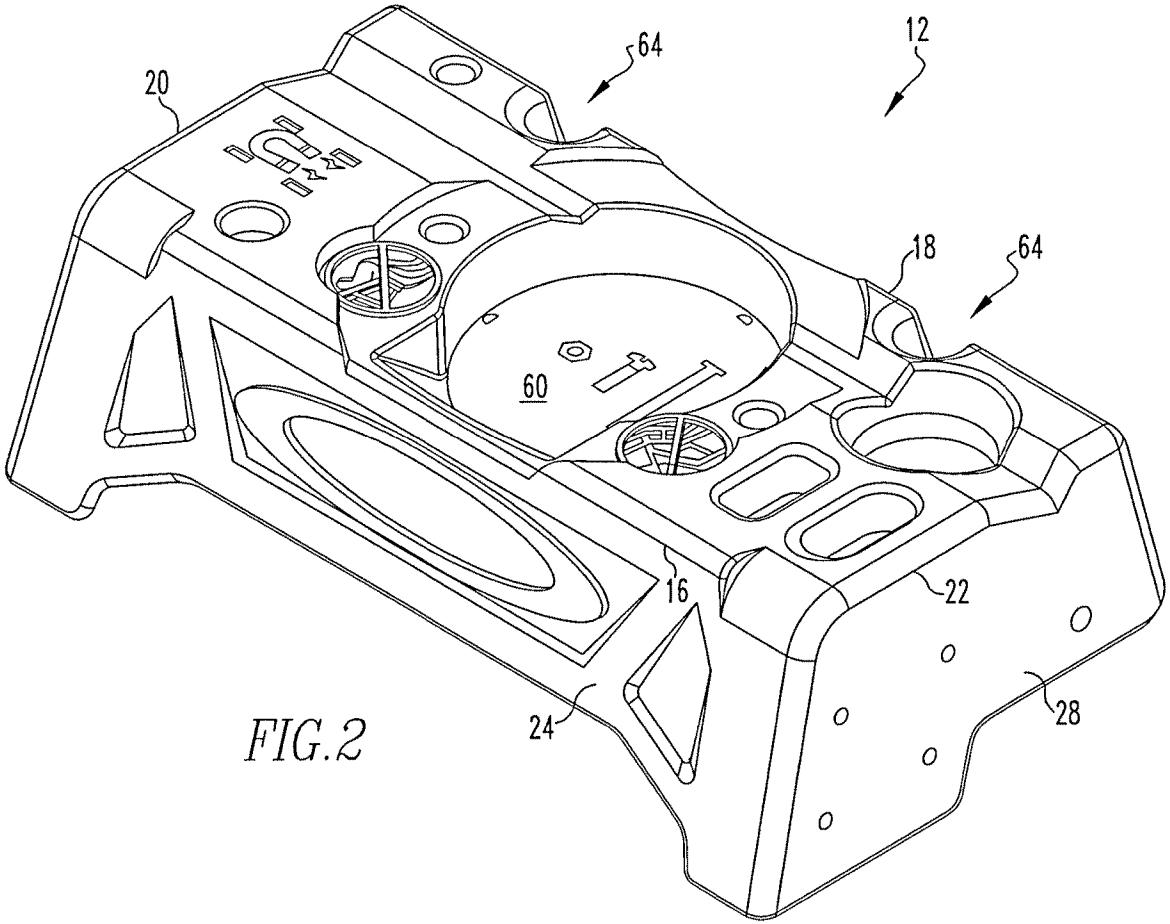
FIG. 2 is a perspective view of the ladder top of the present invention.

Referring now to the drawings wherein like reference numerals refer to similar or identical parts throughout the several views, and more specifically to FIGS. 1 and 2 thereof, there is shown a stepladder 10. The stepladder 10 comprises a ladder top 12 having a plane 14 having a front side 16 and a rear side 18 and a left side 20 and a right side 22 and a front side flange 24 and a rear side flange 26 and a left side flange 28 and a right side flange 30. The stepladder 10 comprises a conduit holder slot 32 for holding tubing, pipe 34 and conduit. The conduit holder slot 32 extends along the entire length of the top 12 and in the right side 22 and the left side 20. The conduit holder slot 32 has a cross-section in the ladder top 12 which is non-symmetrical. The stepladder 10 has a front section 36 having a first front rail 38 and a second front rail 40 in parallel and spaced relation with the first front rail 38 and a step attached to the first and second front rail 38, 40. The first front rail 38 and the second front rail 40 extend from the top 12 and are permanently attached to a respective side flange. The stepladder 10 comprises a rear section 42 having a first rear rail 44 and a second rear rail 46 in parallel and spaced relation with the first rear rail 44. The first rear rail 44 and the second rear rail 46 extend from the top 12 and are permanently attached to a respective side flange. The ladder top 12 and the front and rear sections 36, 42 form the stepladder 10.

The conduit holder slot 32 may have a first side 48 with a flat portion 50. The conduit holder slot 32 may have a second side 52 with a flat portion 54. The second side 52 has a shallower lead-in angle relative to the plane 14 and relative to the first side 48 which has a steeper angle than the lead-in angle relative to the plane 14. The second side 52 may be closer to the front of the top 12 than the first side 48, and the conduit holder slot 32 is essentially in parallel with the front of the top 12.

The ladder top 12 may have an underside with a plurality of snaps 56, and a magnet 58 held in place to the underside by the plurality of snaps 56. The ladder top 12 may have a parts tray 60 for holding parts in the plane 14 that is configured to hold a quart paint can. The plane 14 may have a periphery 62 and a bungee tool holding slot 64 having an opening 66 in the periphery 62 and a circular region 68 that extends into the plane 14 from the opening 66. The conduit holder may be disposed adjacent the rear of the plane 14 adjacent the rear side 18 of the top 12.

The top 12 may have at least one screwdriver hole 78 for holding a screwdriver and a pliers hole 80. The rear side flange 26 may have a top 12 and a bottom, and the bungee tool holding slot 64 is wider at the top 12 than the bottom. The bungee slot may be disposed at the rear of the plane 14. The stepladder 10 may have linkages 84. A linkage 84 connects between the first front rail 38 and the first rear rail 44, and another linkage 84 connects between the second front rail 40 and the second rear rail 46.

The stepladder may include a first brace attached to the first front rail and the step to support the step. The stepladder may include a first foot which fits on the first front rail's bottom to cover and protect the bottom. The first foot is a separate piece from the first brace. There may also be a second brace attached to the second front rail in the step to support the step. There may also be a second foot which fits on the second front rail's bottom to cover and protect the bottom of the second rail. The second foot is a separate piece from the second brace.

The present invention pertains to a method for cutting a tube. The method comprises the steps of placing the tube onto a conduit holder slot on a ladder top of a stepladder. The conduit holder slot for holding tubing, pipe or conduit. The conduit holder slot extending along the entire length of the top and in the top's right side and left side. The conduit holder slot having a cross section in the ladder top which is non-symmetrical. There is the step of cutting the tube while it is disposed in the conduit holder slot.

Figure 3:
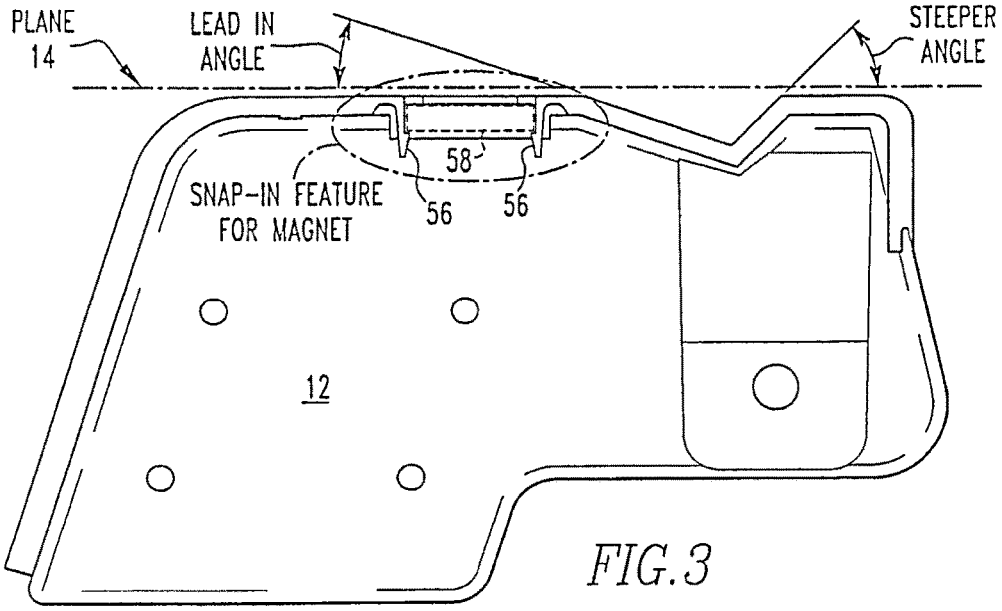
FIG. 3 is a side view of the ladder top emphasizing the snapping feature for the magnet.

FIG. 2 shows a general isometric view of the top 12. FIG. 3 shows a cross-section view of snap features to hold the magnet 58 in place. FIG. 2 shows the magnet 58 is on the left side 20 and snaps in from underneath. The top 12 has a flat area around the magnet 58 for holding parts and tools.

Figure 4:
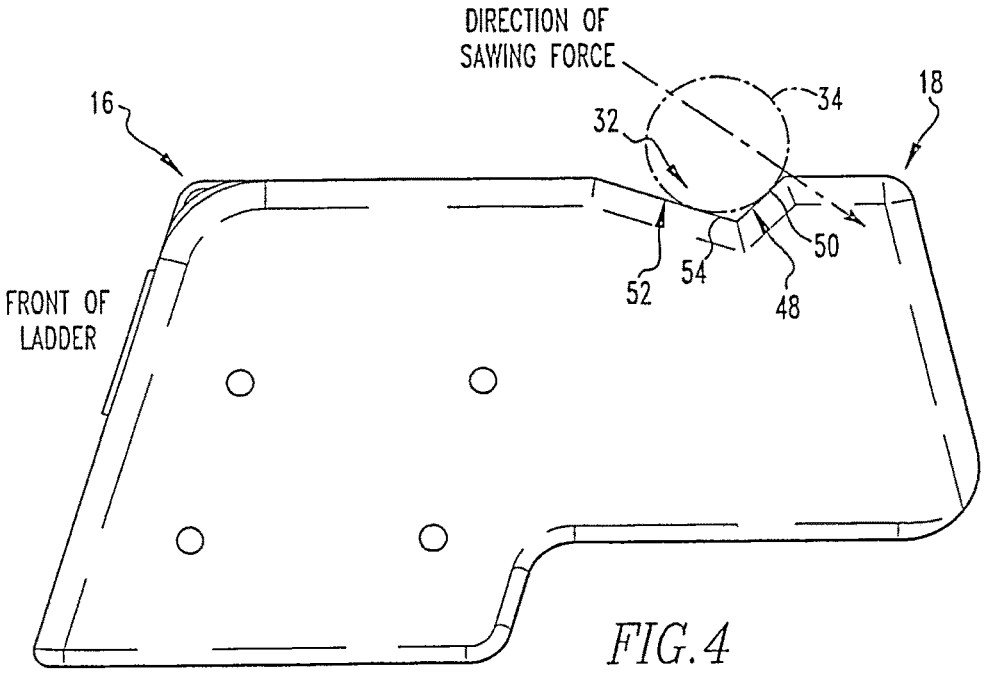
FIG. 4 is a side view of the conduit of the ladder top with the conduit holder slot.

FIG. 4 shows a side view of the conduit holder slot 32. The conduit holder slot 32 of the ladder top 12 has a non-symmetrical cross section in the top 12. From the front of the ladder, the conduit holder slot 32 has a shallower lead-in angle and a steeper back. When cutting a pipe 34 or tube or conduit, the shallow lead-in angle creates a wedging action with the direction of cut, tending to roll the pipe 34 or tube or conduit to the back of the slot. The force applied during cutting is roughly perpendicular with the back angle, so the pipe 34 or tube or conduit is not likely to spin or ride up out of the slot.

Figure 5:
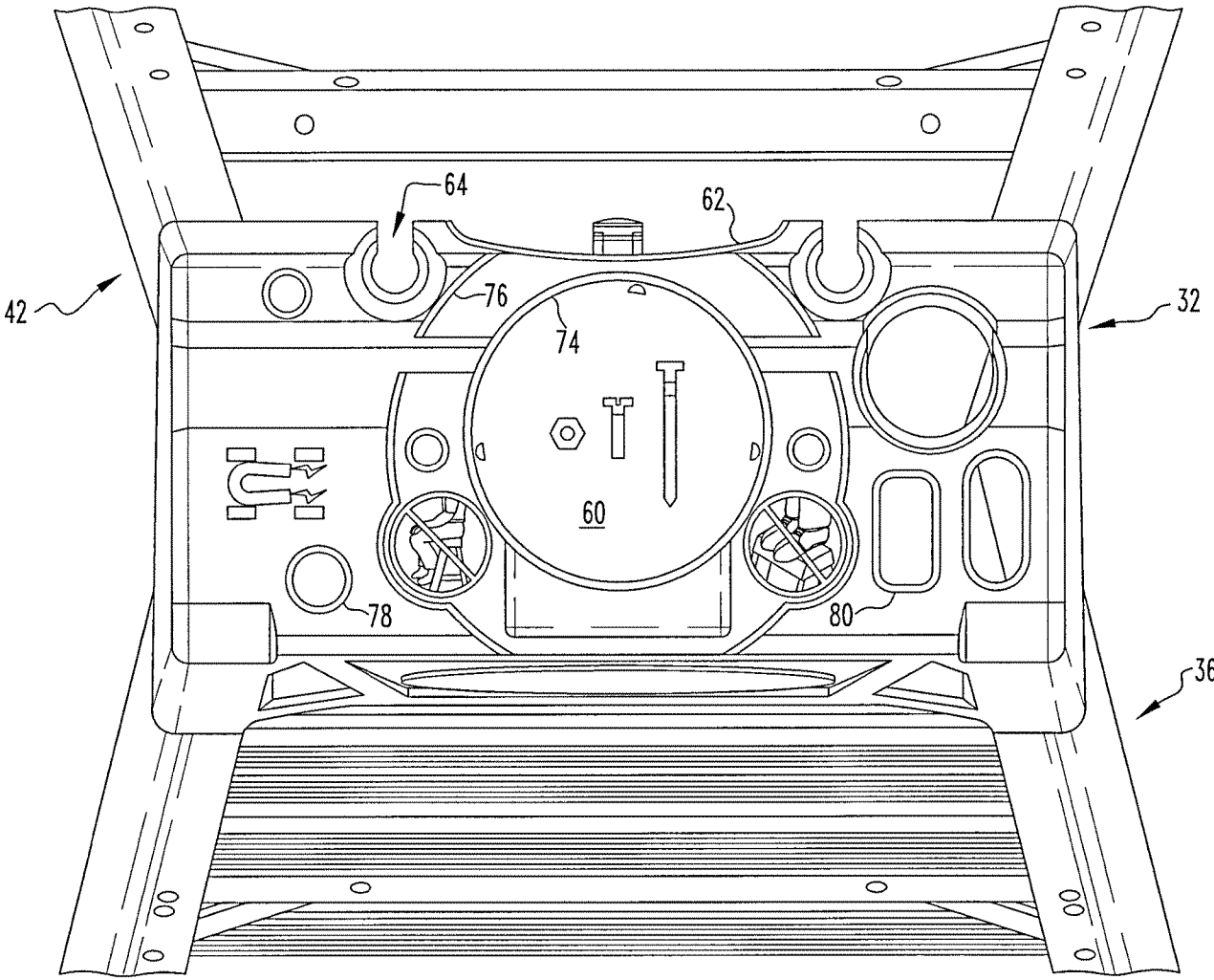
FIG. 5 is an overhead view of the ladder top of the stepladder.

FIG. 5 shows an overhead view of the ladder top 12 on the ladder. The parts tray 60, defined by a first circular shaped indentation, is sized to hold a standard US quart paint can (has a radius slightly larger than the radius of the standard US quart paint can) and has an outer gallon portion defined by a second circular shaped indentation, but not as deep as the first indentation 74, disposed about the tray which is sized to hold a standard US gallon paint can (has a radius slightly larger than the radius of the standard US gallon paint can). There are tool lasso slots and a paint can hanger on the rear side 18 of the top 12. See U.S. Pat. No. 8,376,085, and U.S. patent application Ser. No. 11/449,457, both of which are incorporated by reference herein. The tool lasso slot holds a tool lasso, with whatever object is attached to the tool lasso, and the hanger holds a paint can or any other object that is hanged from the hanger.

Figure 6:
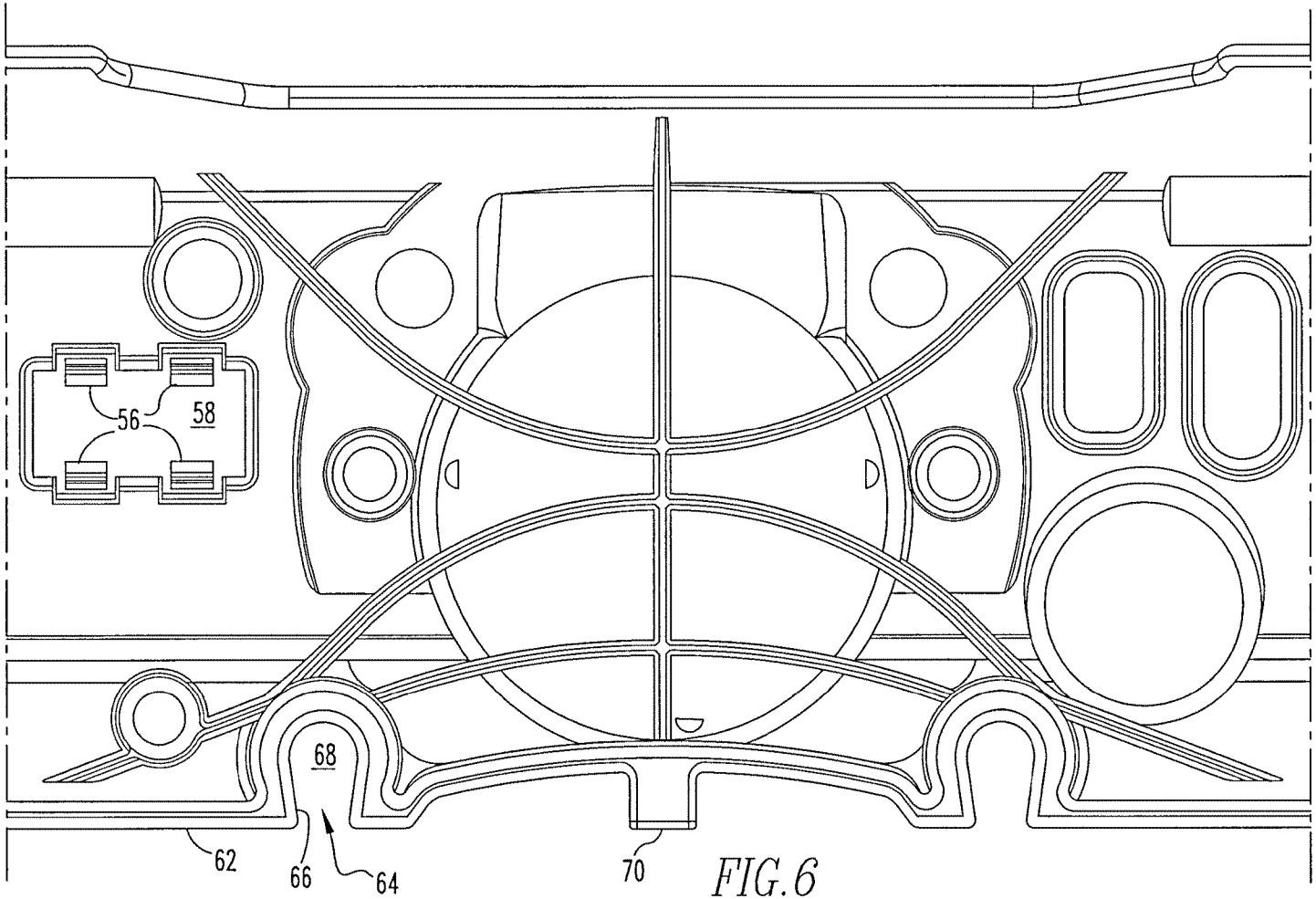
FIG. 6 is an underside view of the ladder top.
Figure 7:
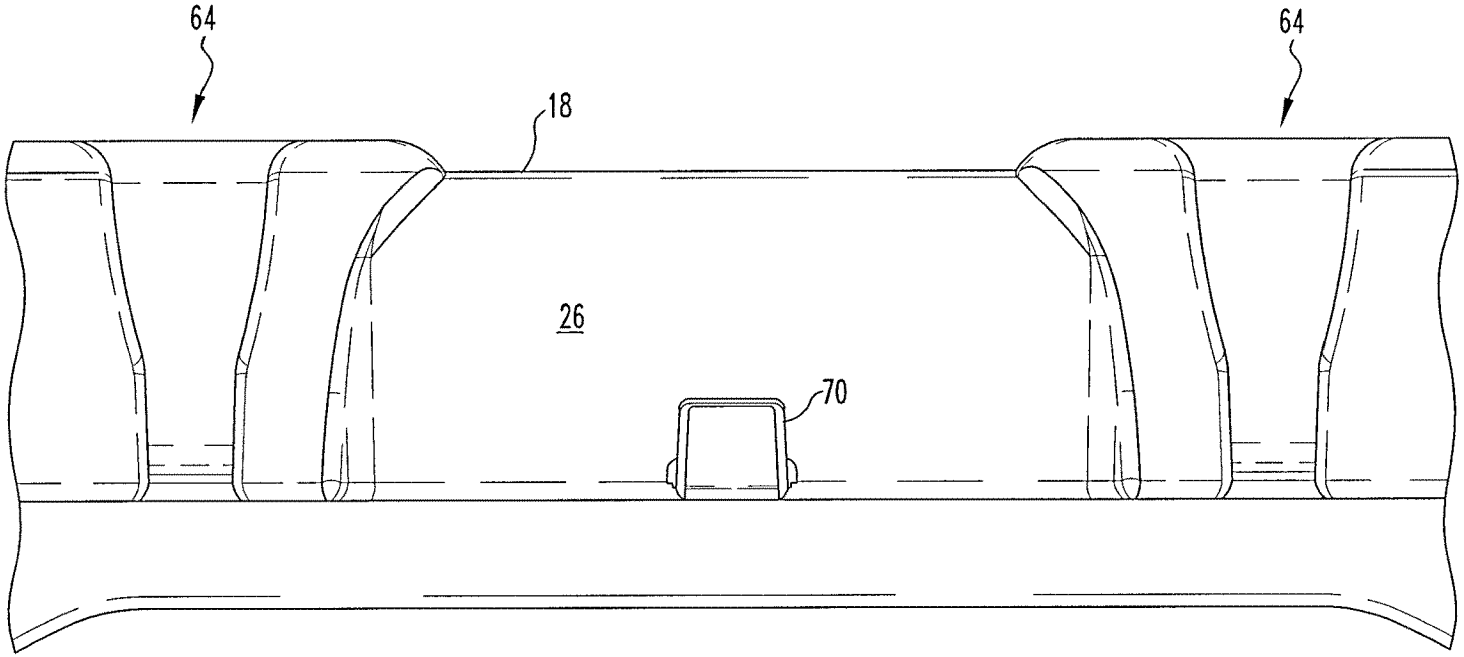
FIG. 7 is a rear side view of the ladder top showing the tool Lasso slots and paint can holder.

FIG. 6 shows the underside of the ladder top 12. FIG. 7 shows the rear side 18 of the top 12 with the tool lasso slots and paint can holder 70 shown.

Figure 8:
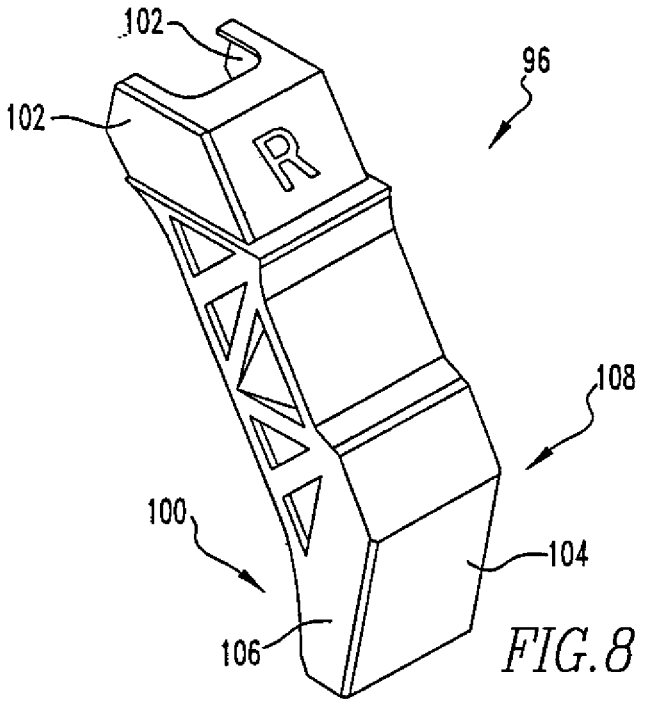
FIG. 8 shows a first brace.
Figure 9:
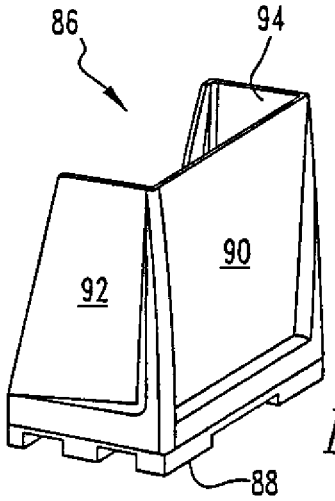
FIG. 9 shows a first foot.

The stepladder 10 may include a first brace 96, as shown in FIG. 8, attached to the first front rail 38 and the step 99 to support the step 99. The stepladder 10 may include a first foot 86, as shown in FIG. 9, which fits on the first front rail's bottom to cover and protect the bottom. The first foot 86 is a separate piece from the first brace 96.

The first foot 86 has a pad 88 attached to the bottom of the first foot 86 to provide better traction for the first front rail 38 to hold firm to the ground. The first foot 86 has a foot face 90 that conforms to the outside surface of the web of the first front rail 38. The foot first foot 86 has a first foot flange 92 and a second foot flange 94 which conform with and are alongside the first flange and the second flange respectively of the first front rail 86. The foot face 90, first foot flange 92 and second foot flange 94 are one continuous piece of plastic and protect the bottom of the first front rail 38 from scratches or damage from impacts that could degrade the integrity and strength of the first front rail 38. Each of the other rail bottoms also have a foot to protect them.

The brace 96 attaches to the sides of the step 99 through top flanges 102 of the top flange 100 with rivets, where one of the top flanges 102 attaches to each side of the step 99. The bottom portion 100 of the brace 96 attaches to the inside of the first front rail 38 with rivets. The brace face 104 conforms with and contacts the inner surface of the web of the first front rail 38, the brace first flange 106 conforms with and contacts the inner surface of the first flange of the first front rail 38, and the second brace flange 108 conforms with and contacts the inner surface of the second flange of the first front rail 38. In this way, a brace also attaches to the second front rail 40 and the step 99, and also is attached to the first rear rail 44 and second rear rail 46 and a horizontal of the rear section 42.

In the operation of the invention, a user places the stepladder 10 in a desired location and opens the front section 36 relative to the rear section 42 and snaps the spreaders into the open position so the front and rear sections 36, 42 cannot close and the stepladder 10 cannot fall over. When a pipe 34, conduit or two needs to be sawed; the pipe 34, tube or conduit are placed in the conduit holder slot 32. The angle of the second side 52 of the conduit holder slot 32 relative to the first side 48 of the conduit holder slot 32 is deeper, which prevents the pipe 34 from coming out of the conduit holder slot 32 as it is being sawed under the action force of the saw on the pipe 34. The non-symmetrical shape of the conduit holder slot 32 in the ladder top 12 essentially allows a wedging force to be created by the conduit holder slot 32 under the force of the siding on the pipe 34.

The user can place small screws, bolts and nuts in the parts tray 60 for easy access, and can also put relatively small metal objects, such as screws, bolts, nuts, small pliers or screwdrivers were small tools made of metal over the magnet 58 in the top 12, which will be held to the ladder top 12 with the magnet 58. Similarly, there are various slots or holes in the ladder top 12 that the user can place various objects, such as paintbrushes, screwdrivers, pliers, wrenches in for easy access.

If the user wishes to place a quart paint can on the tray, the parts tray 60 has a radius defined by a first indentation 74 that is slightly larger than the radius of the quart paint can, so as to provide a secure location for the quart paint can on the tray top 12. Similarly if instead of a quart paint can, a gallon paint can is desired to be placed in the ladder top 12, the second indentation 76 surrounding the first indentation 74, but shallower than the first indentation 74 has a radius which is slightly larger than the radius of a gallon paint can so as to hold the gallon paint can securely on the ladder top 12. The user may also hang a tool Lasso with an object, such as a drill attached to the tool Lasso from the tool Lasso slot in the rear of rear side 18 of the top 12. Alternatively, the user can also place paint cans or hang other objects from the paint can holder 70 on the rear side 18 of the ladder top 12. See FIGS. 6 and 7.

As shown in FIGS. 3 and 6, a magnet 58 snaps into the underside of the ladder top 12 and is held in place by snaps 56 on the underside of the ladder top 12. The right side 22 and a left side 20 of the ladder top 12 have holes, as shown in FIGS. 3 and 4, through which screws or rivets can pass to permanently attach the front side 16 rails of the front section 36 to the ladder top 12 and the rear side rails of the rear section 42 to the ladder top 12 as is well known in the art.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A method for cutting a tube comprising the steps of:

placing the tube onto a conduit holder slot on a ladder top of a stepladder, the top having a surface having a front side and a rear side and a right side and a left side and a length, the conduit holder slot for holding tubing, pipe or conduit, the conduit holder slot extending along the length of the surface and in the surface's right side and left side, the conduit holder slot having sides in contact with each other and which form a cross section in the ladder top which is V-shaped and non-symmetrical; and cutting the tube, pipe, or conduit while the tube, pipe, or conduit is disposed in the conduit holder slot where the conduit holder slot allows a wedging force to be created by the conduit holder slot in response to a cutting or sawing force applied to the tube, pipe, or conduit, wherein the conduit holder slot has a first side with a flat portion, and wherein the conduit holder slot has a second side with a flat portion, the second side has a shallower lead-in angle relative to the surface and relative to the first side which has a steeper angle than the lead-in angle relative to the surface.

2. The method of claim 1 wherein the second side is closer to the front side of the surface than the first side, and the conduit holder slot is in parallel with the front side of the top.

3. The method of claim 2 wherein the ladder top has an underside with a plurality of fasteners, and a magnet held in place to the underside by the plurality of fasteners.

4. The method of claim 3 wherein the ladder top has a parts tray for holding parts in the surface, the tray is configured to hold a quart paint can.

5. The method of claim 4 wherein the surface has a periphery and a bungee tool holding slot having an opening in the periphery and a circular region that extends into the surface from the opening.

6. The method of claim 5 wherein the conduit holder slot is disposed adjacent the rear side of the surface.

7. The method of claim 6 wherein the top has at least one screwdriver hole for holding a screwdriver; and a hole for holding a pliers.

8. The method of claim 7 wherein the surface has a front side flange and a rear side flange and a right side flange and a left side flange and the rear side flange has a top and a bottom, and the bungee tool holding slot is wider at the top than the bottom.

9. The method of claim 8 wherein the bungee slot is disposed at the rear side of the surface.

10. The method of claim 9 including a first brace attached to a first front rail of the stepladder and a step of the stepladder, the first brace supporting the step.

11. The method of claim 10 including a first foot which fits on a bottom of the first front rail to cover and protect the bottom of the first front rail, the first foot is a separate piece from the first brace.

* * * * *